United States Patent [19]

Baschin

[11] 4,400,045

[45] Aug. 23, 1983

[54] BUILT-IN KITCHEN UNIT

[75] Inventor: Horst Baschin, Bruchsal, Fed. Rep. of Germany

[73] Assignee: Neff-Werke Carl Neff GmbH, Bretten, Fed. Rep. of Germany

[21] Appl. No.: 232,419

[22] Filed: Feb. 6, 1981

[30] Foreign Application Priority Data

Feb. 15, 1980 [DE] Fed. Rep. of Germany ... 8004602[U]
Feb. 15, 1980 [DE] Fed. Rep. of Germany ..... 3005600

[51] Int. Cl.[3] ..... A47B 77/08; F24C 15/18

[52] U.S. Cl. ..... 312/236; 312/301; 312/306; 312/312; 312/238; 126/37 R

[58] Field of Search ..... 312/312, 306, 301, 21, 312/311, 200, 238, 239, 236; 126/37 R

[56] References Cited

U.S. PATENT DOCUMENTS

| | | | |
|---|---|---|---|
| 804,957 | 11/1905 | Keller | 312/306 |
| 967,783 | 8/1910 | Kellogg | 126/37 R |
| 1,099,521 | 6/1914 | Sprung | 312/312 |
| 1,612,730 | 12/1926 | Keichline | 126/37 R |
| 1,782,523 | 11/1930 | Warren | 312/311 |
| 1,963,281 | 6/1934 | Rogers | 126/37 R |
| 2,244,211 | 6/1941 | Nelson | 312/312 |
| 2,539,613 | 1/1951 | Earle | 126/37 R |
| 2,658,985 | 11/1953 | Maxwell | 126/37 R |
| 2,889,442 | 6/1959 | Schultz | 126/37 R |
| 2,919,340 | 12/1959 | Jacobs | 126/37 R |
| 3,028,209 | 4/1962 | Hinkel et al. | 312/312 |
| 3,157,175 | 11/1964 | Pearce et al. | 126/37 R |
| 3,358,669 | 12/1967 | Schibley | 126/37 R |
| 3,472,219 | 10/1969 | Roy et al. | 126/37 R |
| 3,650,591 | 3/1972 | Longmire, Sr. | 312/312 |

*Primary Examiner*—Victor N. Sakran
*Attorney, Agent, or Firm*—Spencer & Kaye

[57] ABSTRACT

A built-in kitchen system including a baking and roasting oven and a surface cooking unit, which system includes a plurality of cabinet modules disposed adjacent one another and provided with countertops defining a horizontal work surface, a wall cabinet housing integrated into the system and having an upper portion accommodating the oven and a lower portion accommodating the cooking unit, a device mounting the cooking unit in the housing for horizontal displacement between a position within the housing and a position in front of the housing, and a displacement device supporting the wall cabinet housing and arranged to move the housing vertically between raised and lowered positions, the raised position being located to place the bottom of the cooking unit level with the work surface.

7 Claims, 3 Drawing Figures

BUILT-IN KITCHEN UNIT

BACKGROUND OF THE INVENTION

The present invention relates to a built-in kitchen unit containing a baking and roasting oven and a cook top, or cooking surface, equipped with a plurality of surface cooking elements, the unit being composed of cabinet-like components which are arranged immediately adjacent one another and are covered with a countertop, or countertops, to form a work surface.

In known built-in units of this type, the baking and roasting oven is arranged either next to the cabinet-like units, and thus is installed underneath the countertops, or it is inserted into a recess of a wall cabinet approximately at chest level. In the former arrangement of the baking and roasting oven, the user must insert or remove the baking or roasting containers, e.g. pans, sheets or baking dishes, into the cooking chamber when in a bent-over position, while with the accommodation of the baking and roasting oven in the more highly situated recess, the containers for the baked goods can be inserted and removed essentially while in an upright position. In both cases, while operating the oven cooking chamber, the user is hindered by the oven door which is generally pivotally mounted below the cooking chamber so as to extend, when in its opened position, horizontally forward from the baking and roasting oven.

Particularly when removing hot baked goods containers carrying hot baked goods there exists the grave danger, if manipulation is not adept, of incurring burn injuries. Older and handicapped persons, in particular, are exposed to such dangers to a great degree. The associated cooking surface with its built-in cooking elements is generally set into a countertop in an area under which the baking and roasting oven is disposed. Use of the cooking surface is also associated with a certain danger for handicapped persons because of the baking and roasting over being disposed therebelow, particularly if the oven is in a heated state. Moreover, the cooking recess inserted into the countertop interrupts the continuity of the work surface and an easily accessible work area is lost in this way for other work.

SUMMARY OF THE INVENTION

It is an object of the present invention to provide a solution to the above-stated problems.

The above and other objects are achieved, according to the invention, in a built-in kitchen system including a baking and roasting oven and a surface cooking unit, which system includes a plurality of cabinet modules disposed adjacent one another and provided with countertops defining a horizontal work surface, by the provision of a wall cabinet housing integrated into the system and having an upper portion accommodating the oven and a lower portion accommodating the cooking unit, a device mounting the cooking unit in the housing for horizontal displacement between a position within the housing and a position in front of the housing, and a displacement device supporting the wall cabinet housing and arranged to move the housing vertically between raised and lowered positions, the raised position being located to place the bottom of the cooking unit level with the work surface.

The solution offered by the invention facilitates the manipulation of the baking and roasting oven as well as of the cooking surface and makes it safer, in particular, for handicapped persons. Moreover, when not in use, these components can be moved out of the way of the handicapped person while they are performing other work on the countertop so that their freedom of movement will not be restricted even further.

The advantages realized by the present invention are essentially that loading and unloading of the baking and roasting oven cooking chamber is possible in the plane which is most comfortable for the user, i.e. at the level of the countertop. Thus, lowering or raising of the baked goods carriers by the user, which could be difficult, is avoided. During loading of the oven, the cooking surface with its cooking elements is out of reach and thus does not constitute a hindrance for work at the oven. When both the baking and roasting oven and the cooking surface are not in use, the entire work surface is freely available for other work.

Due to the fact that the cooking surface is made to be pushed or rolled in and out, the work surface is not interrupted by any protruding components, as is the case when a cooking surface is inserted into the work surface. This results in a continuous and smooth work area which is easy to keep clean.

DESCRIPTION OF THE PREFERRED EMBODIMENTS

Figure 1:
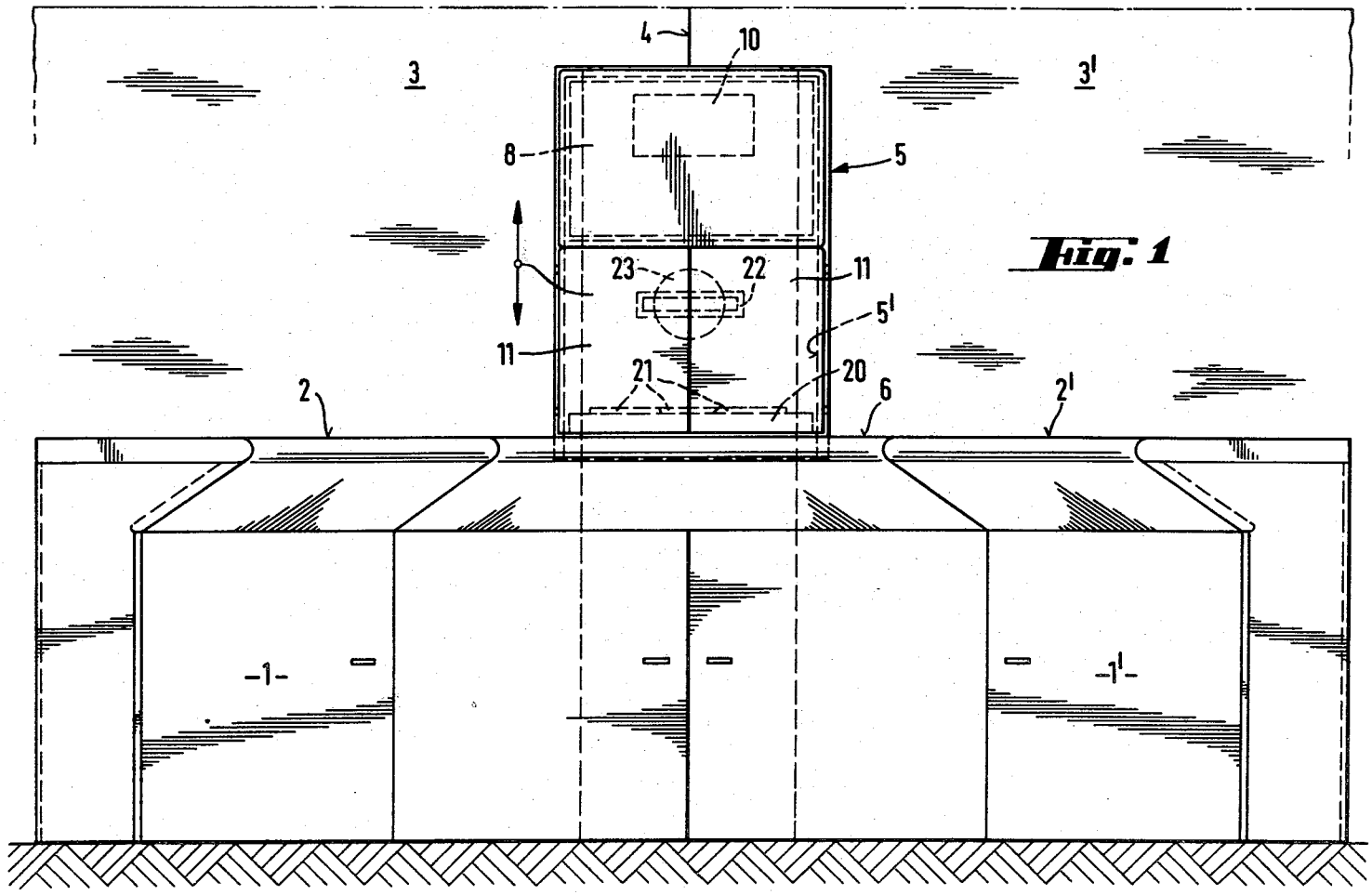
FIG. 1 is a frontal elevational view of a built-in kitchen unit according to a preferred embodiment of the invention.
Figure 2:
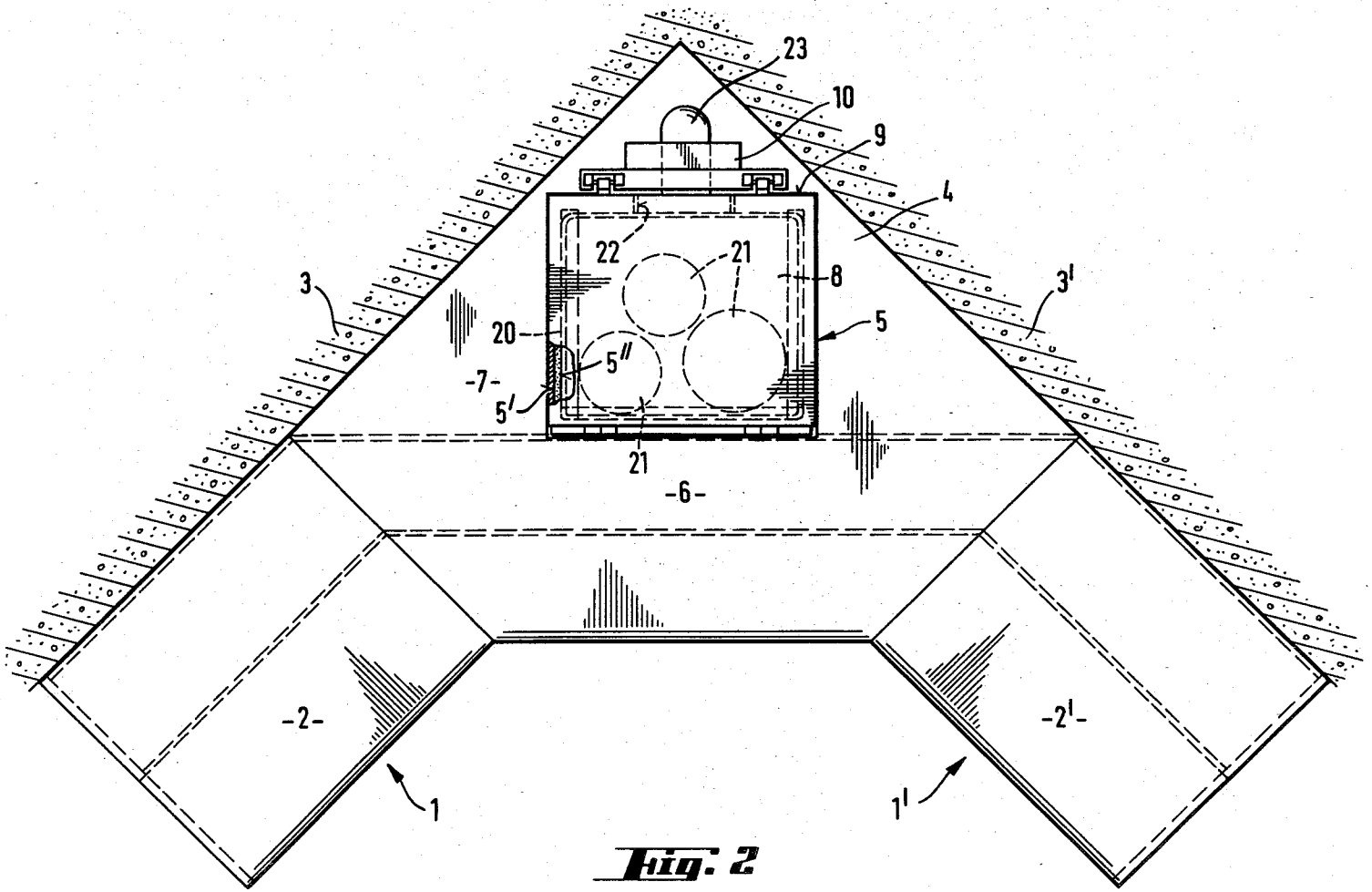
FIGS. 2 and 3 are top plan views of the embodiment of FIG. 1 in two different operating states.

The built-in kitchen unit shown in the Figures includes a plurality of cabinet-like units 1 and 1' which are mounted on the kitchen floor and are aligned one directly next to the other in order to form a closed kitchen furniture front. They are then covered with a continuous countertop 2, 2' which forms the work surface.

In the illustrated, preferred embodiment, the individual units 1 and 1' are arranged at room walls 3, 3' which are at a right angle to one another. The arrangement has been made in such a way that a so-called dead space 4 is formed between the units 1 and 1'. In this dead space there is provided, as a further module, wall cabinet housing 5. The two countertops 2 and 2' of the units 1 and 1' are connected together in front of the wall cabinet housing 5 by a coplanar countertop 6 so that here again a work surface is provided in front of the wall cabinet housing 5. At the level of the countertops 2, 2', the free space in the dead space 4 around cabinet housing 5 is also covered with a countertop 7 of the same type.

In the upper portion of the wall cabinet housing 5 there is accommodated a baking and roasting oven 8. Housing 5 is supported via its rear wall 9, by a lifting device 10 which is fixed to the kitchen floor. With this lifting device, the wall cabinet housing 5 with the baking and roasting oven 8 disposed therein can be moved up and down. Thus it is possible, in particular, to bring a cooking container support surface of the cooking chamber of the baking and roasting oven 8 into a horizontal plane with the countertop 6 disposed in front thereof so that loading and unloading of the cooking chamber can be performed by the user in the plane of the work plate 6. Such a cooking container support surface could be constituted by the floor of the cooking chamber or by an oven rack.

Figure 3:
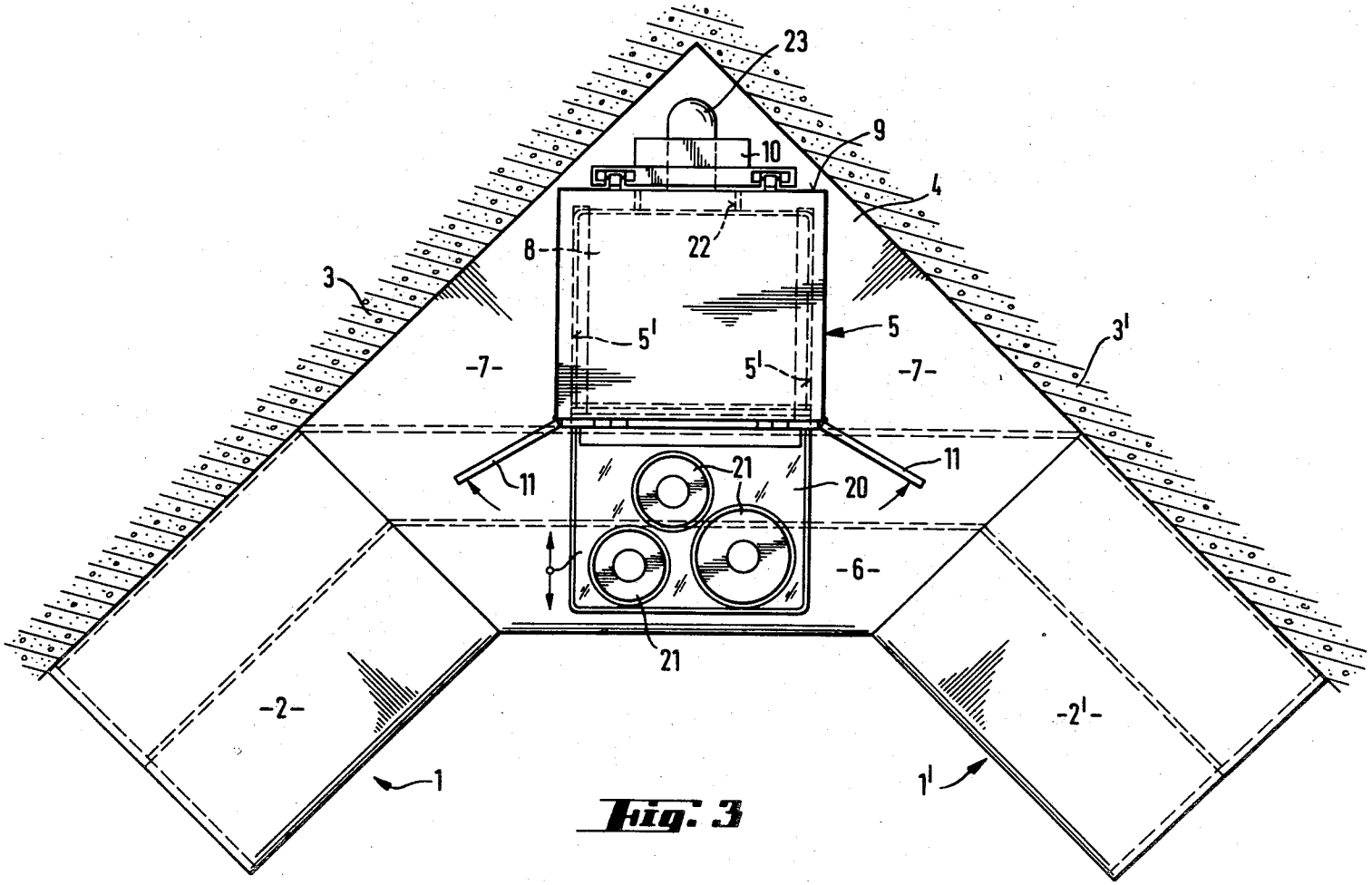

Underneath the baking and roasting oven 8, wall cabinet housing 5 presents a further chamber 5' which is advisably enclosed or lined with a heat insulation layer 5''. In the bottom region of this chamber there is advantageously disposed a so-called cooking surface 20 having a plurality of surface cooking elements 21. The cooking elements 21 may be the conventional mass-produced resistive heating elements or may be designed in the form of an electrically heated glass-ceramic unit. The chamber 5' is closed by folding doors 11 which can be pivoted out to the sides as shown in FIG. 3. Moreover, at its rear wall, the chamber 5' is provided with exhaust ventilation openings 22 which are required during use of cooking surface 20. These air ventilation openings are in communication, via a conduit or the like, with a rearwardly disposed ventilating device 23 which is equipped with an exhaust fan.

In its rest or starting position, the cooking surface 20 is disposed in the chamber 5' and the folding doors 11 are closed. Actuation of a control button produces a pulse which causes the cooking surface 20 to be moved out of the chamber 5' at the level of the countertop 6 while simultaneously pivoting open the folding doors 11. The cooking chamber 20 in its extended position is then available to the immediate access of the user. After use of the cooking surface 20, it is returned into the chamber 5' again by actuation of a control pulse and then the folding doors 11 close automatically, or can be closed manually.

It would also be possible to perform a cooking process with the cooking surface 20 located inside the chamber 5' and with the folding doors 11 closed. Advisably, the chamber 5' is then equipped with a temperature responsive circuit breaker which monitors the temperature existing therein. Such devices are well-known in the art.

The ventilating device 23 is automatically switched on when the cooking surface 20 is moved out of the chamber 5' and is switched off again with a certain delay after the cooking unit has been returned to its storage position.

Housing 5 can be mounted to lifting device 10 in any suitable manner, as by rollers, and can be equipped with any suitable motor driven mechanisms, such as rope or chain and pulley systems or threaded rod and spindle units, for effecting vertical movement of housing 10. Similarly, cooking surface 20 can be mounted on conventional roller supports and connected to a power driven displacement system, e.g. a chain drive system, for moving the surface out of and back into chamber 5'. Pivoting of doors 11 can be effected manually or automatically by means of known devices such as miniature motor-driven threaded spindles of solenoids. Control of the various motors can equally be effected in conventional ways by means of buttons, dials, etc., controlling suitable control circuits.

It will be understood that the above description of the present invention is susceptible to various modifications, changes and adaptations, and the same are intended to be comprehended within the meaning and range of equivalents of the appended claims.

What is claimed is:

1. In a built-in kitchen system including a baking and roasting oven and a surface cooking unit, which includes a plurality of cabinet modules disposed adjacent one another and provided with countertops defining a horizontal work surface, the improvement comprising: a wall cabinet housing integrated into said system and having an upper portion accommodating said oven and a lower portion accommodating said cooking unit; means mounting said cooking unit in said housing for horizontal displacement between a position within said housing and a position in front of said housing; and displacement means supporting said wall cabinet housing and arranged to move said housing vertically between raised and lowered positions, the raised position being located to place the bottom of said cooking unit level with said work surface.

2. An arrangement as defined in claim 1 further comprising a layer of heat insulation surrounding said lower portion of said housing.

3. An arrangement as defined in claim 1 or 2 wherein the rear of said lower portion is provided with air extraction openings which are in communication, via a conduit, with a ventilating device.

4. An arrangement as defined in claim 1 or 2 wherein said lower portion is equipped with a temperature responsive circuit breaker.

5. An arrangement as defined in claim 1, wherein said oven is accommodated in said housing so that at the raised position of said housing said oven is accessible for use.

6. In a built-in kitchen system including a baking and roasting oven and a surface cooking unit, which includes a plurality of cabinet modules disposed adjacent one another and provided with countertops defining a horizontal work surface, the improvement comprising; a wall cabinet housing integrated into said system and having an upper portion accomodating said oven and a lower portion accomodating said cooking unit; means mounting said cooking unit in said housing for horizontal displacement between a position within said housing and a position in front of said housing; and displacement means supporting said wall cabinet housing and arranged to move said housing vertically between a raised position and at least one lowered position, the raised position being located to place the bottom of said cooking unit level with said work surface and said at least one lowered position being located to place the bottom of said oven level with said work surface.

7. An arrangement as defined in claim 5 wherein said at least one lowered position includes a second lowered position, said second lowered position being located to place the top of said wall cabinet housing level with said work surface.

* * * * *